US005745036A

United States Patent [19]

Clare

[11] Patent Number: 5,745,036

[45] Date of Patent: Apr. 28, 1998

[54] ELECTRONIC ARTICLE SECURITY SYSTEM FOR STORE WHICH USES INTELLIGENT SECURITY TAGS AND TRANSACTION DATA

[75] Inventor: Thomas J. Clare, Media, Pa.

[73] Assignee: Checkpoint Systems, Inc., Thorofare, N.J.

[21] Appl. No.: 712,746

[22] Filed: Sep. 12, 1996

[51] Int. Cl.[6] ..... G08B 13/14

[52] U.S. Cl. ..... 340/572; 340/568; 340/571; 340/825.54; 235/375

[58] Field of Search ..... 340/572, 568, 340/571, 825.03, 825.54, 825.31, 539, 551, 505; 235/375, 380, 435, 385; 364/478.13; 343/742, 867; 342/51; 283/85, 74, 82, 72; 365/101, 230.05

[56] References Cited

U.S. PATENT DOCUMENTS

| | | | |
|---|---|---|---|
| 3,752,960 | 8/1973 | Walton | 340/825.3 |
| 3,816,708 | 6/1974 | Walton | 340/825.3 |
| 4,036,308 | 7/1977 | Fockens | 340/572 |
| 4,141,078 | 2/1979 | Bridges, Jr. et al. | 340/572 |
| 4,223,830 | 9/1980 | Walton | 235/380 |
| 4,580,041 | 4/1986 | Walton | 235/380 |
| 4,688,026 | 8/1987 | Scribner et al. | 340/572 |
| 4,746,830 | 5/1988 | Holland | 310/313 D |
| 4,827,395 | 5/1989 | Anders et al. | 340/679 |
| 4,837,568 | 6/1989 | Snaper | 340/825.54 |
| 4,857,893 | 8/1989 | Carroll | 340/572 |
| 4,881,061 | 11/1989 | Chambers | 340/568 |
| 4,924,210 | 5/1990 | Matsui et al. | 340/572 |
| 5,019,815 | 5/1991 | Lemelson et al. | 340/933 |
| 5,059,951 | 10/1991 | Kaltner | 340/572 |
| 5,099,226 | 3/1992 | Andrews | 340/572 |
| 5,099,227 | 3/1992 | Geiszler et al. | 340/572 |
| 5,103,222 | 4/1992 | Hogen Esch et al. | 340/825.54 |
| 5,119,070 | 6/1992 | Matsumoto et al. | 340/572 |
| 5,153,842 | 10/1992 | Dlugos, Sr. et al. | 364/485.15 |
| 5,214,409 | 5/1993 | Beigel | 340/572 |
| 5,214,410 | 5/1993 | Verster | 340/572 |
| 5,218,343 | 6/1993 | Stobbe et al. | 340/572 |
| 5,288,980 | 2/1994 | Patel et al. | 340/572 |
| 5,339,074 | 8/1994 | Shindley et al. | 340/825.31 |
| 5,347,263 | 9/1994 | Carroll et al. | 340/572 |
| 5,353,011 | 10/1994 | Wheeler et al. | 340/572 |
| 5,430,441 | 7/1995 | Bickley et al. | 340/825.54 |
| 5,432,864 | 7/1995 | Lu et al. | 382/118 |

(List continued on next page.)

FOREIGN PATENT DOCUMENTS

| | | |
|---|---|---|
| 494114 | 7/1992 | European Pat. Off. . |
| 585132 | 3/1994 | European Pat. Off. . |
| 598624 | 5/1994 | European Pat. Off. . |
| 615285 | 9/1994 | European Pat. Off. . |

OTHER PUBLICATIONS

Bowers, J., "Road to intelligent tagging is paved with opportunities", *Automotive I.D. News*, Oct. 1995, 86–87.

*Primary Examiner*—Brent A. Swarthout
*Assistant Examiner*—Van T. Trieu
*Attorney, Agent, or Firm*—Panitch Schwarze Jacobs & Nadel, P.C.

[57] ABSTRACT

An electronic article security system monitors articles sold by a retail store to detect shrinkage. The articles are tagged with RF-ID security tags. Each security tag has a unique or semi-unique serial number for identifying individual products. Transaction records generated from point-of-sale terminals in the store are sent to a remote computer. An interrogator and surveillance camera are positioned near the store exit. When an article having the RF-ID security tag is detected as passing through the store exit, the interrogator outputs a signal derived from the security tag. The output signal includes the security tag serial number. Also, the camera takes an image of the person moving the tagged article through the exit. The interrogator output signal is sent to the remote computer. The remote computer periodically compares the transaction records with the interrogator output signals to detect any discrepancies therebetween. The discrepancies are investigated by viewing the captured video images near the time of the discrepancies.

24 Claims, 6 Drawing Sheets

U.S. PATENT DOCUMENTS

| | | | |
|---|---|---|---|
| 5,444,223 | 8/1995 | Blama | 235/435 |
| 5,446,447 | 8/1995 | Carney et al. | 340/572 |
| 5,448,110 | 9/1995 | Tuttle et al. | 340/825.54 |
| 5,450,070 | 9/1995 | Massar et al. | 340/572 |
| 5,450,492 | 9/1995 | Hook et al. | 340/572 |
| 5,469,363 | 11/1995 | Saliga | 364/478.13 |
| 5,471,203 | 11/1995 | Sasaki et al. | 340/825.31 |
| 5,490,079 | 2/1996 | Sharpe et al. | 364/467 |
| 5,497,140 | 3/1996 | Tuttle | 340/825.32 |
| 5,499,017 | 3/1996 | Beigel | 340/572 |
| 5,519,381 | 5/1996 | Marsh et al. | 340/572 |
| 5,589,820 | 12/1996 | Robinson et al. | 340/572 |
| 5,604,486 | 2/1997 | Lauro et al. | 340/572 |

| SECURITY TAG IDENTIFICATION INFORMATION | PRODUCT IDENTIFICATION INFORMATION |
|---|---|
| S/N 001 | SONY 21" TV-Model No. 2106 |
| S/N 002 | SONY 21" TV-Model No. 2106 |
| S/N 003 | SONY 21" TV-Model No. 2106 |
| . | |
| . | |
| . | |
| S/N 010 | SONY 25" TV-Model No. 2504 |
| S/N 011 | SONY 25" TV-Model No. 2504 |
| S/N 012 | SONY 25" TV-Model No. 2504 |
| . | |
| . | |
| S/N 020 | KENWOOD Car Stereo-Model No. 101 |
| S/N 021 | KENWOOD Car Stereo-Model No. 101 |
| S/N 022 | KENWOOD Car Stereo-Model No. 101 |
| . | |
| . | |
| . | |
| S/N 100 | PACKARD-BELL COMPUTER 486SX/25 |

FIG. 3

TRANSACTION RECORD 36

| FIELD | DATA |
|---|---|
| TRANSACTION NUMBER | 12345 |
| STORE | 21 |
| DATE OF PURCHASE | 6-14-96 |
| TIME OF PURCHASE | 13:30 |
| CUSTOMER NAME AND ADDRESS | (optional) |
| PURCHASE ITEMS AND PICK UP INSTRUCTIONS | (1) SONY 21" TV-MODEL NO. 2106 IMMEDIATE PICK UP |

FIG. 4

TRANSACTION DATABASE

40

| | | | | |
|---|---|---|---|---|
| 1. PURCHASE | SONY 21" TV-Model 2106 | 6-14-96 | 13:30 | IMMEDIATE |
| 2. PURCHASE | Kenwood Car Stereo-Model 101 | 6-14-96 | 14:20 | IMMEDIATE |

FIG. 5(a)

EVENT DATABASE

46

| | | | |
|---|---|---|---|
| 1. Serial Number 001 | SONY 21" TV-Model 2106 | 6-14-96 | 13:39:08:88 |
| 2. Serial Number 020 | Kenwood Car Stereo-Model 101 | 6-14-96 | 14:31:43:20 |
| 3. Serial Number 021 | Kenwood Car Stereo-Model 101 | 6-14-96 | 14:31:43:30 |

FIG. 5(b)

DISCREPANCY REPORT

68

6-14-96

ARTICLE: (1) Kenwood Car Stereo-Model 101

DISCREPANCY: NO CORRESPONDING PURCHASE DATA FOR ARTICLE DETECTED AT 14:31:43:20 or 14:31:43:30

FIG. 5(c)

ELECTRONIC ARTICLE SECURITY SYSTEM FOR STORE WHICH USES INTELLIGENT SECURITY TAGS AND TRANSACTION DATA

FIELD OF THE INVENTION

The present invention relates generally to electronic article security systems which use resonant security tags.

BACKGROUND OF THE INVENTION

Electronic article security (EAS) systems for detecting and preventing theft or unauthorized removal of articles or goods from retail establishments and/or other facilities, such as libraries, have become widespread. In general, such security systems employ a security tag which is secured to or associated with an article (or its packaging), typically an article which is readily accessible to potential customers or facility users and, therefore, is susceptible to unauthorized removal. Security tags may take on many different sizes, shapes and forms depending upon the particular type of EAS system in use, the type and size of the article to be protected, the packaging for the article, etc. In general, such EAS systems are employed for detecting the presence (or the absence) of a security tag and, thus, a protected article within a surveilled security area or detection zone. In most cases, the detection zone is located at or around an exit or entrance to the facility or a portion of the facility.

One type of EAS system which has gained widespread popularity utilizes a security tag which includes a self-contained, passive resonant circuit in the form of a small, generally planar printed circuit which resonates at a predetermined detection frequency within a detection frequency range. A transmitter; which is also tuned to the detection frequency, is employed for transmitting electromagnetic energy into the detection zone. A receiver, tuned to the detection frequency, is positioned proximate to the detection zone. Typically, the transmitter and a transmitter antenna are located on one side of an exit or aisle and the receiver and a receiver antenna are located on the other side of the exit or aisle, so that a person must pass between the transmitter and receiver antennas in order to exit the facility. When an article having an attached security tag moves into or passes through the detection zone, the security tag is exposed to the transmitted energy, resulting in the resonant circuit of the tag resonating to provide an output signal detectable by the receiver. The detection of such an output signal by the receiver indicates the presence of an article with a security tag within the detection zone and the receiver activates an alarm to alert appropriate security or other personnel.

Existing EAS systems of the type described above and of other types have been shown to be effective in preventing the theft or unauthorized removal of articles. However, there are many ways to defeat such systems. For example, the security tag may be removed or prematurely deactivated by customers or store personnel. The transmitter/receiver device (i.e., interrogator) may be temporarily deactivated by either a customer or store personnel. A customer might flee from the store with stolen merchandise even though the interrogator trips an audible or visible alarm. Store personnel may have intimate knowledge of the security system and may know of other ways to temporarily defeat the system or to assist a customer in defeating the system. While the mere presence of a visible security system sometimes deters theft, it also invites clever ways to defeat the system.

Another problem with existing EAS systems is that movement of articles out of the store is not correlated with transaction activity at the cash register. Thus, it is difficult to determine whether an article detected within the detection zone is being stolen or was actually purchased but the security tag was not properly deactivated.

Security tags used in a particular store or store chain are typically identical. Thus, all articles, regardless of size or value, which include the security tag return an identical signal to the interrogator's receiver. Recently, passive resonant security tags which return unique or semi-unique identification codes were developed. U.S. Pat. Nos. 5,446,447 (Carney et al.), 5,430,441 (Bickley et al.), and 5,347,263 (Carroll et al.) disclose three examples of such security tags. These security tags typically include an integrated circuit to generate the identification code. While such "intelligent" security tags provide additional information about the article detected in the zone of the interrogator, they do not allow movement of articles to be correlated with transaction activity at the cash register.

Studies show that store employees are responsible for a large amount of store theft (shrinkage). Typically, one or only a few employees are responsible for most of the theft for a particular store. Some employees sometimes carry out the thefts by working with friends who pose as customers. Employee theft is very difficult to detect. As noted above, EAS systems may be easily defeated by employees.

Despite the progress made in reducing theft through the use of EAS systems, there is still a need for an EAS system which can more effectively detect and identify persons who steal articles from a store. The present invention fills this need.

SUMMARY OF THE INVENTION

The present invention provides an electronic article security system for use in conjunction with articles having a security tag attached thereto. The security tag includes a resonant circuit for use in detecting the presence of the article by receiving an interrogation signal and returning a response signal. The security tag also includes an integrated circuit connected to the resonant circuit for storing article identification information and for outputting the article identification information with the response signal upon interrogation of the security tag. The system comprises one or more point-of-sale (POS) terminals, an interrogator, and a computer. The POS terminals record article transactions including article purchases. The transaction records include specific product identification information. The interrogator monitors a detection zone for disturbances in the form of a response signal caused by the presence of a security tag within the zone. The interrogator outputs an interrogator output signal when a security tag is detected in the zone. Each interrogator output signal includes the article identification information stored in the integrated circuit. The computer receives and stores the transaction records and the interrogator output signals. The computer includes means for comparing the transaction records and the interrogator output signals, including the product and article identification information, and detecting any discrepancies which occur therebetween. The system further includes a video camera and video recorder. The video camera captures images of the detection zone and outputs video signals of the captured images. The video recorder stores the video signals on a video storage medium. The video storage medium is used to investigate the detected discrepancies.

Another embodiment of the invention provides a method for monitoring articles for shrinkage detection using the apparatus described above.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 3 is a sample sequence of database records for tracking articles with embedded security tag for use with the system of FIG. 1;

FIG. 4 is a sample store transaction record generated by the system of FIG. 1;

FIG. 5(*a*) shows sample records for a store transaction database used in the system of FIG. 1;

FIG. 5(*b*) shows sample records for an event database used in the system of FIG. 1;

FIG. 5(*c*) shows a sample discrepancy report generated from the records in the transaction and event databases of FIGS. 5(*a*) and 5(*b*);

DETAILED DESCRIPTION OF PREFERRED EMBODIMENT

Figure 1:
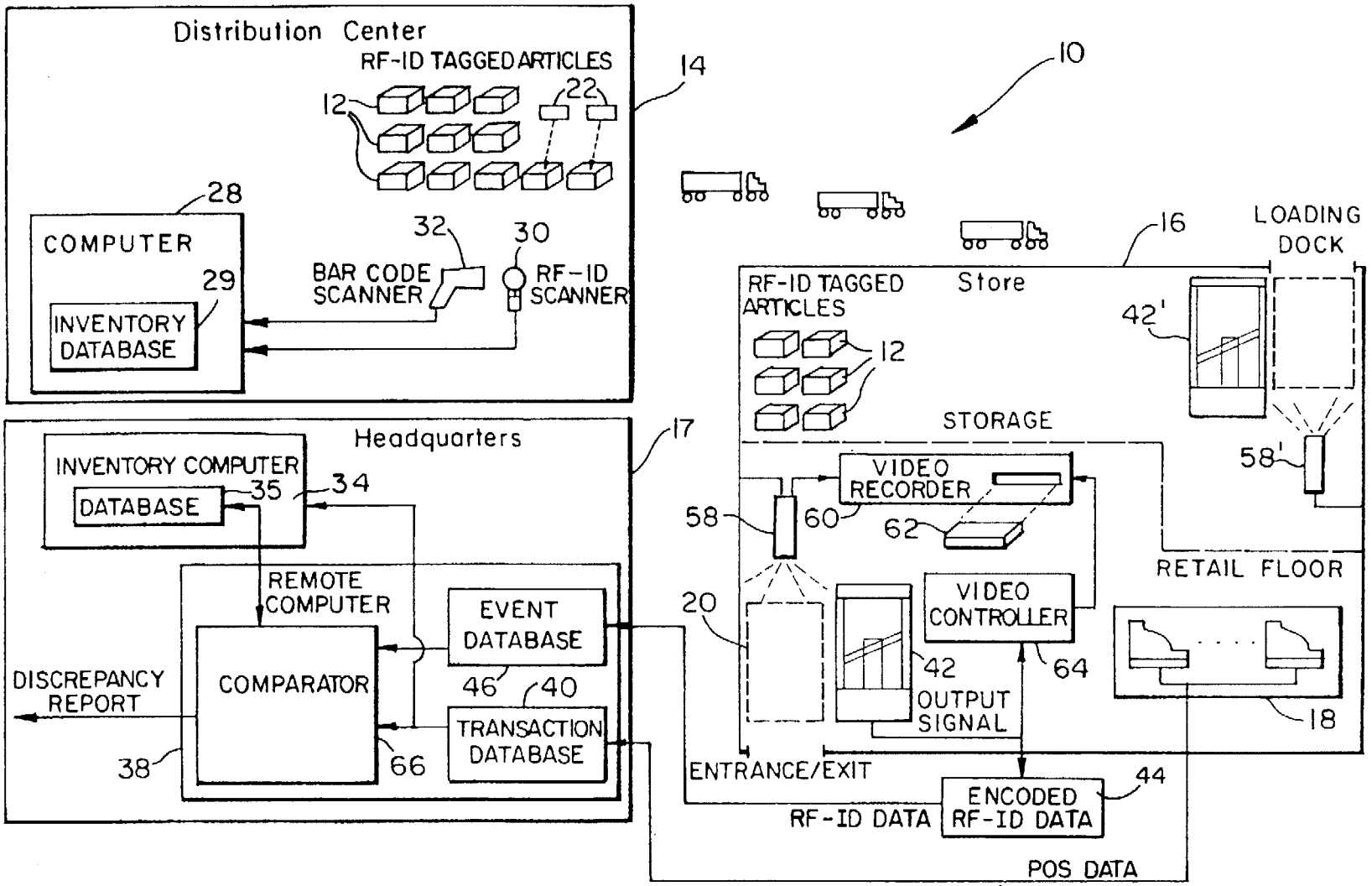
FIG. 1 is a detailed functional block diagram schematic of an electronic article security (EAS) system in accordance with a first preferred embodiment of the present invention.

Certain terminology is used herein for convenience only and is not be taken as a limitation on the present invention. In the drawings, the same reference numerals are employed for designating the same elements throughout the several figures.

FIG. 1 shows a detailed functional block diagram schematic of an electronic article security (EAS) system 10 in accordance with a preferred embodiment of the present invention. In the preferred embodiment, articles 12 are initially housed in a retail distribution center 14. When desired, the articles 12 are delivered to a particular retail store 16 and placed in a storage area or on the retail shelves of the store 16. Information regarding the articles 12 shipped to the retail store 16 is sent to a retail store headquarters 17, which may be located remotely from the distribution center 14 and from the retail store 16. Customers typically view floor samples of the articles 12 on the retail floor of the store 16. When a customer wishes to buy one or more articles 12, the customer approaches a point-of-sale (POS) terminal or register associated with a POS system 18 and pays for the article(s) 12. Information regarding article transactions (e.g., purchases, exchanges, returns) is sent to the retail store headquarters 17 for inventory management and shrinkage control analysis. Next, the purchased article(s) 12 are retrieved from the storage area of the retail store 16 and given to the customer, if they were not already on the retail floor. The customer then walks out of the store 16 with the purchased articles(s) 12 with or without the help of store personnel. While exiting the store 16, the customer passes through a predesignated detection zone 20. An interrogator 42 detects the presence of the purchased article 12 in the detection zone 20 and records information pertaining to them, as described more fully below.

For simplicity, FIG. 1 shows only one distribution center 14 and one retail store 16. However, there may be a plurality of retail stores 6 which receive articles 12 from the distribution center 14 and which send their article information to the headquarters 17. There may also be a plurality of distribution centers 14 in communication with the headquarters 17 and with one or more retail stores 16.

During the process described above, various data regarding each article 12 are collected which allows the retail establishment to detect whether any shrinkage or other irregularities are occurring with respect to the inventory of articles 12. To assist in such detection, each article 12 is provided with a security tag 22. The security tags 22 are attached to the articles 12 at the retail store distribution center 14, or at an earlier stage in the distribution chain, such as at the point of manufacture. Alternatively, the security tags 22 may be attached to the articles 12 at the retail store 16. In either scheme, the security tags 22 remain attached to the articles 12 at least until they are purchased and taken out of the retail store 16 and preferably for the entire life of the article 12. The security tags 22 are preferably hidden from plain view, and potentially even hidden within the articles 12, to minimize awareness of the presence of the tags 22 and to prevent removal of, or tampering with, the tags 22.

Figure 2:
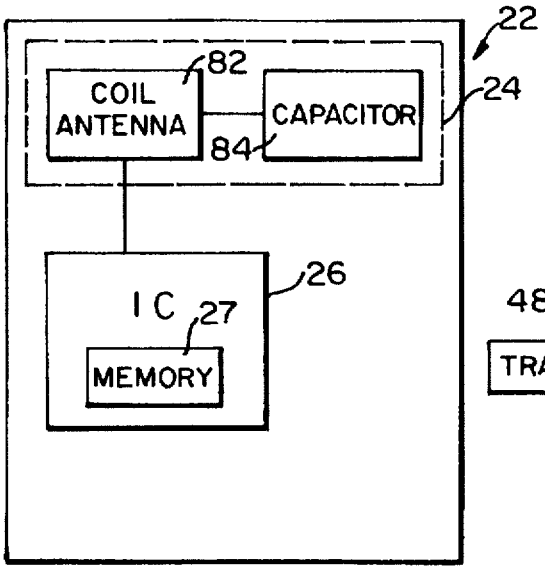
FIG. 2 is a block diagram schematic of a security tag suitable for use with the system of FIG. 1.

FIG. 2 shows general details of a sample security tag 22 suitable for use with the present invention. The security tag 22 includes a passive resonant radio frequency (RF) circuit 24 for use in detecting when the tag 22 is within a zone monitored by an interrogator, as is well-known in the art. One well-known type of circuit 24 has a coil antenna 82 and a capacitor 84. Power for the security tag 22 is derived from the antenna in a conventional manner.

The security tag 22 further includes an integrated circuit (IC) 26 for providing "intelligence" to the security tag 22. The IC 26 is connected to the circuit 24. The IC 26 includes a programmable memory 27, such as a 64 bit memory, for storing bits of identification data. The IC 26 outputs a data stream comprised of the 64 bits of data when sufficient power is applied thereto. In one embodiment of the invention, the data stream creates a series of data pulses by switching an extra capacitor across the coil antenna 82 for the duration of the pulse. This changes the resonant frequency of the RF circuit 24, detuning it from the operational frequency. Thus, instead of the RF circuit 24 returning a simple response signal, it returns a signal containing a packet of preprogrammed information. The packet of information (data pulses) is processed by interrogator receiving circuitry and is decoded (if necessary) to provide identification information about the article 12. Other methods of using the data in the IC memory 27 to output identification data from the security tag 22 are within the scope of the invention. The IC 26 is preferably also a passive device and is powered in the same manner as the RF circuit 24 (i.e., by using energy received at the antenna 82 from the interrogator transmitter signal). The security tag 22 is thus a so-called "radio frequency (RFID or RF-ID) intelligent tag", or "intelligent security tag." The security tag 22 is preferably physically non-deactivatable.

Referring to FIG. 1, the retail store distribution center 14 receives blank (unprogrammed) security tags 22, assigns unique serial numbers or other data to each of the tags 22 by suitable programming (if they are not already preassigned), attaches the tags 22 to articles 12, and creates a database which correlates the number or data of each security tag 22 to the respective product. The programming step is eliminated if the articles 12 arrive at the distribution center 14 pretagged and with preassigned serial numbers or data, in which case the tags 22 attached to each article are read with an interrogator and the correlation database is created.

In the example illustrated herein, the retail store distribution center 14 applies security tags 22 to 100 articles. Next, a distribution center computer 28 is used to update an inventory database 29 stored therein in the following manner:

1. An article 12 is read by an RF-ID scanner 30 which extracts the unique programmed serial number from the security tag 22.
2. A database record is added for the serial number in the inventory database 29.
3. Next, bar coding on the article 12 is read by a conventional bar code scanner 32 to obtain the product identification information. This information is added to the new record in the inventory database 29. Alternatively, the RF-ID tag could already include such product identification information, in which case, step 3 is unnecessary.

If RF-ID scanners and bar code scanners are not available, the product identification information may be manually entered. When new articles 12 arrive at the distribution center 14, the process is repeated using new security tags 22 programmed with new, unique serial numbers. The latest inventory data is also provided to an inventory computer 34 at the headquarters 17 which compiles the inventory data in a headquarters inventory database 35. After being tagged, the articles 12 are shipped to the retail store 16 and placed in the store for subsequent purchase by a customer. A store inventory computer (not shown) may be updated to include the new shipment of articles 12.

FIG. 3 shows a sample of a sequence of database records created by the process described above. Each record includes a field for security tag identification information (e.g., the serial number of the security tag 22) and a field for product identification information. Security tag identification information is also referred to as "article identification information." That is, because the serial number is unique or semi-unique, it may be used to identify the particular article. Alternatively, as previously described, the security tag 22 could contain some other form of product identification information, as opposed to a unique serial number.

Figure 8:
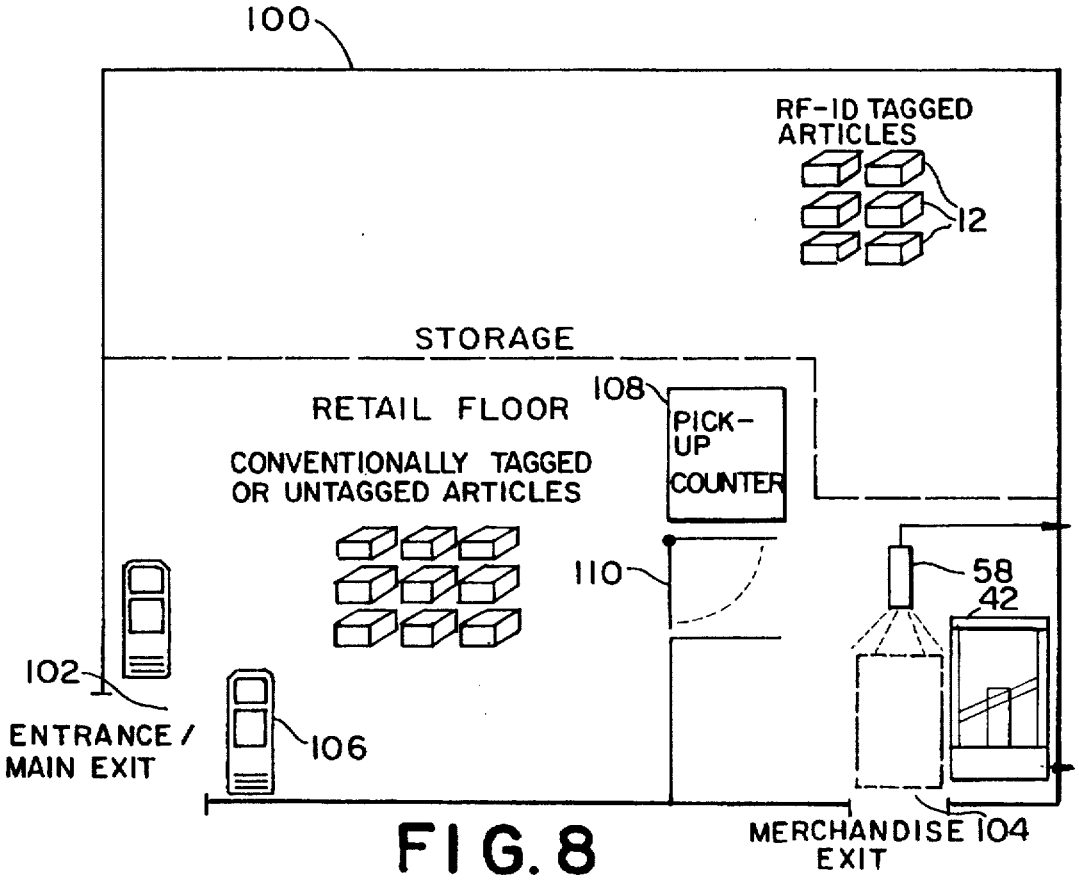
FIG. 8 is a modified store floor plan for use with the EAS system of FIG. 1 in accordance with a third preferred embodiment of the present invention.

Referring again to FIG. 1, the events which occur in the retail store 16 are now described in more detail. Once a customer decides to buy an article 12, the customer approaches a point-of-sale (POS) register associated with a POS system 18 and pays for the articles 12. In some instances, the articles 12 may be on the retail floor and the customer merely carries the article 12 to the POS system 18. In other instances, the articles 12 must be retrieved from the store's storage area and brought to the customer after being purchased. In yet another instance, the customer must go to a separate article pick-up area of the store, which has a separate entrance/exit, as shown in FIG. 8, described below. A transaction record is generated for each sale in a conventional manner, such as by scanning a bar code on the article 12 or on a pick-up ticket for the article 12 using a conventional bar code scanner, or by typing in the article's product code directly into a POS keyboard. For simplicity, the customer in the example below buys only two items, a television and a car stereo.

FIG. 4 shows a sample transaction record 36 generated by the purchase of the television and car stereo. The transaction record 36 is output from a respective POS register of the POS system 18. The transaction record 36 includes a field for pick up instructions. This field indicates whether purchased articles 12 are being taken immediately or at a later time, and is important to know when correlating transaction records 36 with article movement data. Transaction records (POS data) 36 for each customer transaction are sent to the inventory computer 34 at the headquarters 17, and also to a remote computer 38 located in the headquarters 17. Alternatively, the transaction records 36 may be sent to either one of the remote computer 38 or the inventory computer 34 and the receiving computer may send the information to the other computer. The transaction records 36 may also be sent to a local store inventory computer (not shown). The inventory computer 34 uses the transaction records 36 to update inventory for the entire store chain.

Referring to FIG. 5(*a*), the remote computer 38 compiles a transaction database 40 from the transaction records 36. The transaction database 40 includes a record for each individual article 12 that was subject to a transaction by the POS system 18. Each record preferably includes at least the following information:

(1)Type of transaction (e.g., purchase, exchange, return);
(2) Product description;
(3) Date and time of purchase; and
(4) Pick up instructions.

After receiving and paying for all articles 12, the customer exits the store 16. The exit is located so that the customer must pass through a predesignated zone 20 before passing through, or while passing through, the exit. Referring to FIG. 1, an interrogator 42 monitors the zone 20 for disturbances caused by the presence of a security tag 22 within the zone 20, and outputs a signal when the security tag 22 is detected in the zone 20. In the preferred embodiment of the invention, no audible or visible alarm is activated upon detection. Each interrogator output signal includes a packet of identification information (hereafter "RF-ID data"), as discussed above with respect to FIG. 2. The RF-ID data is appended with date and time information regarding when the security tag 22 was detected, and sent to the remote computer 38 at the headquarters 17. If the RF-ID data is encoded, it may be decoded by a decoder 44 before being sent to the headquarters 17. The decoder 44 may be located remotely from the store 16 and headquarters 17 to enhance the overall security of the system 10. After decoding, the RF-ID data is sent to the remote computer 38 at the headquarters 17. A sample decoded output signal consists of a packet of bits. One sample output signal contains the following information:

(1) Serial number of security tag (i.e., identification information regarding the security tag itself);
(2) Product identification information;
(3) Date and time of detection at zone 20; and
(4) Check bit(s) for error detection and/or correction. The time of detection preferably includes the hour, minute, second, and hundreds of second, when detection occurred so that accurate discrepancy analysis can be performed.

Referring to FIG. 5(*b*), the remote computer 38 translates the RF-ID data to extract the fields of data and compiles an event database 46 from the translated RF-ID data. The event database 46 includes a record for each individual article 12 detected by the interrogator 42 due to the presence of a security tag 22 attached thereto. Each record in the event database 46 includes at least the following information:

(1) Serial number of security tag; and (2) Date and time of detection at zone 20, preferably including the hour, minute, second and hundredths of a second of detection.

The event database may optionally include the product identification information. If so, this information is obtained using the serial number identification information extracted from the RF-ID data and retrieving the related product identification information from the database records described in FIG. 3.

Figure 6:
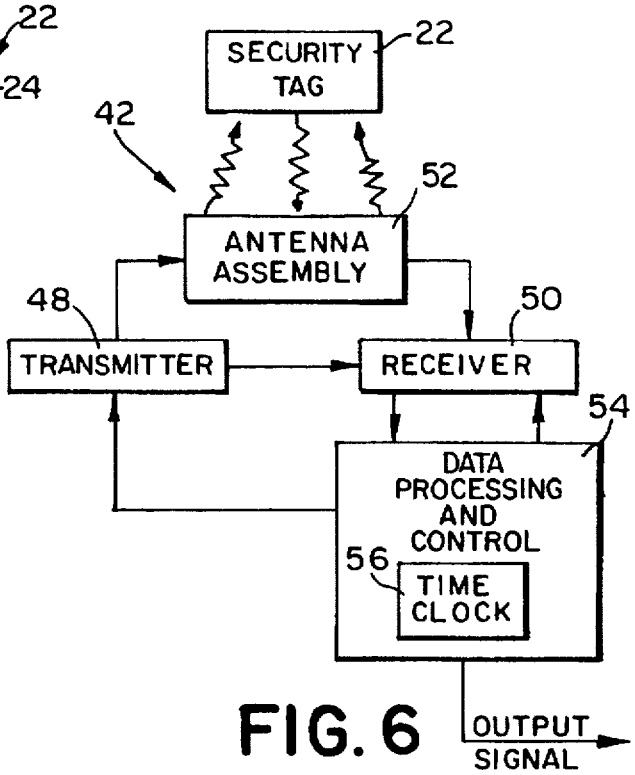
FIG. 6 is a functional block diagram schematic of an interrogator suitable for use with the present invention.

FIG. 6 is a block diagram schematic of an interrogator 42 suitable for use with the security tag 22 described in FIG. 2. The interrogator 42 and the security tag 22 communicate by inductive coupling, as is well-known in the art. The interrogator 42 includes a transmitter 48, receiver 50, antenna assembly 52, and data processing and control circuitry 54, each having inputs and outputs. The output of the transmitter 48 is connected to a first input of the receiver 50, and to the input of the antenna assembly 52. The output of the antenna assembly 52 is connected to a second input of the receiver 50. A first and a second output of the data processing and control circuitry 54 are connected to the input of the transmitter 48 and to a third input of the receiver 50, respectively. Furthermore, the output of the receiver 50 is connected to the input of the data processing and control circuitry 54. Interrogators having this general configuration may be built using circuitry described in U.S. Pat. Nos. 3,752,960, 3,816,708, 4,223,830 and 4,580,041, all issued to Walton, all of which are incorporated by reference in their entirety herein. However, the data processing and control circuitry of the interrogator described in these patents are modified to append date and time data thereto. A time clock 56 is provided in the data processing and control circuitry 54 for appending the date and time data. The interrogator 42 may have the physical appearance of a pair of pedestal structures. In FIG. 1, only one pedestal structure is shown. However, other physical manifestations of the interrogator 42 are within the scope of the invention. It may be desirable to design the interrogator 42 so that it is not visible to either customers or to store employees.

Referring again to FIG. 1, the system 10 further includes a surveillance video camera 58 for capturing an image of the zone 20 and outputting a video signal of the image, and a video recorder 60 for storing the video signal on a portable video storage medium 62, such as a videotape. The video recorder 60 makes either a continuous or event-oriented record of activity in the zone. The video recorder 60 preferably records continuous SMPTE code information (time, date and frame number), or at least time information, on the video storage medium 62. In an alternative embodiment of the invention, a video controller 64 is connected to the interrogator 42 and to the video recorder 60. The video controller 64 activates the video recorder 60 upon detection of a security tag 22 in the zone 20, and deactivates the video recorder 60 a predetermined period of time after the security tag 22 is no longer being detected as being in the zone. In this alternative embodiment, the video recorder 60 also records SMPTE code information or time information for each detection period. Regardless of which recording scheme is used, the resultant video storage medium 62 contains a video image of the movement of each tagged article 12 as it passes through the zone 20, as well as the corresponding time information. The video camera 58 is preferably positioned to capture an image of the article 12, as well as the person carrying the article 12. It may be preferable to hide the video camera 58, as well as the interrogator 42, so that neither customers nor store employees are aware of any recording or article detecting activity.

At periodic intervals, a comparator 66 in the remote computer 38 compares POS data in the transaction database 40 with data in the event database 46. The comparator 66 is loaded with appropriate software to perform its function. If necessary, the comparator 66 extracts information from the inventory database 35 before beginning the comparison. For example, if the RF-ID data includes serial numbers, but not product identification information, and the comparison is being made between product identification information extracted from POS data and articles 12 detected by the interrogator 42, it will be necessary to use database records such as shown in FIG. 3 to retrieve the product identification information for the corresponding serial numbers stored in the event database 46 before the comparison is made. The comparator 66 outputs a discrepancy report highlighting potential discrepancies between the records stored in the two databases.

FIG. 5(*c*) shows a sample discrepancy report 68 for a comparison of the event database 46 and transaction database 40 shown in FIGS. 5(*a*) and 5(*b*). (The databases in FIGS. 5(*a*) and 5(*b*) include all of the event and transaction data for one day of sales at a particular retail store. For simplicity, only the transactions in FIG. 5(*a*) are presumed to have occurred for the entire day.) The example of FIGS. 5(*a*)–(*c*) reveals one discrepancy, namely that the POS data recorded only one purchase of a car stereo at 14:20, but that the interrogator 42 detected two car stereos passing almost simultaneously through the zone 20 shortly thereafter. The likely event that led to this discrepancy is that the customer or employee removed two car stereos from the store 16 at the same time, but only paid for one. The discrepancy thus reveals that one car stereo was improperly removed from the store at 14:31:43:20 or 14:31:43:30. The video storage medium 62 is then searched to locate the video image captured for 6-14-96 at about 14:31 and identify the customer or employee who removed the car stereos.

The software in the comparator 66 includes sufficient intelligence to make accurate comparisons. For example, if a product is purchased for immediate pick up, there is a record in the event database a short time after the transaction was completed. If there are additional POS-detected transactions of the same product at about the same time, the event database shows plural articles 12 passing through the zone 20 a short time later. However, the articles 12 may not pass through the zone 20 in the same exact order of purchase due to delays in the article retrieval process or delays from customer activity within the store. If an article is purchased and pick up is delayed, the comparator 66 should expect the record in the event database to appear much later in time, or on another day. Thus, while the system cannot always definitively determine which customers or employees have improperly removed an article from the store or exactly which article is the improperly removed one, the suspected wrongdoers can be significantly narrowed down to a few culprits when using the system of the present invention.

The discrepancy analysis can be of varying levels of sophistication, as desired. For example, the discrepancy analysis can be programmed to report every discrepancy, whether major or minor. Store personnel can then analyze the report to determine which discrepancies justify the time and effort of viewing the video record. If a store has an extremely large number of transactions, it may be desired to report only major discrepancies, or discrepancies associated with expensive articles.

Figure 7:
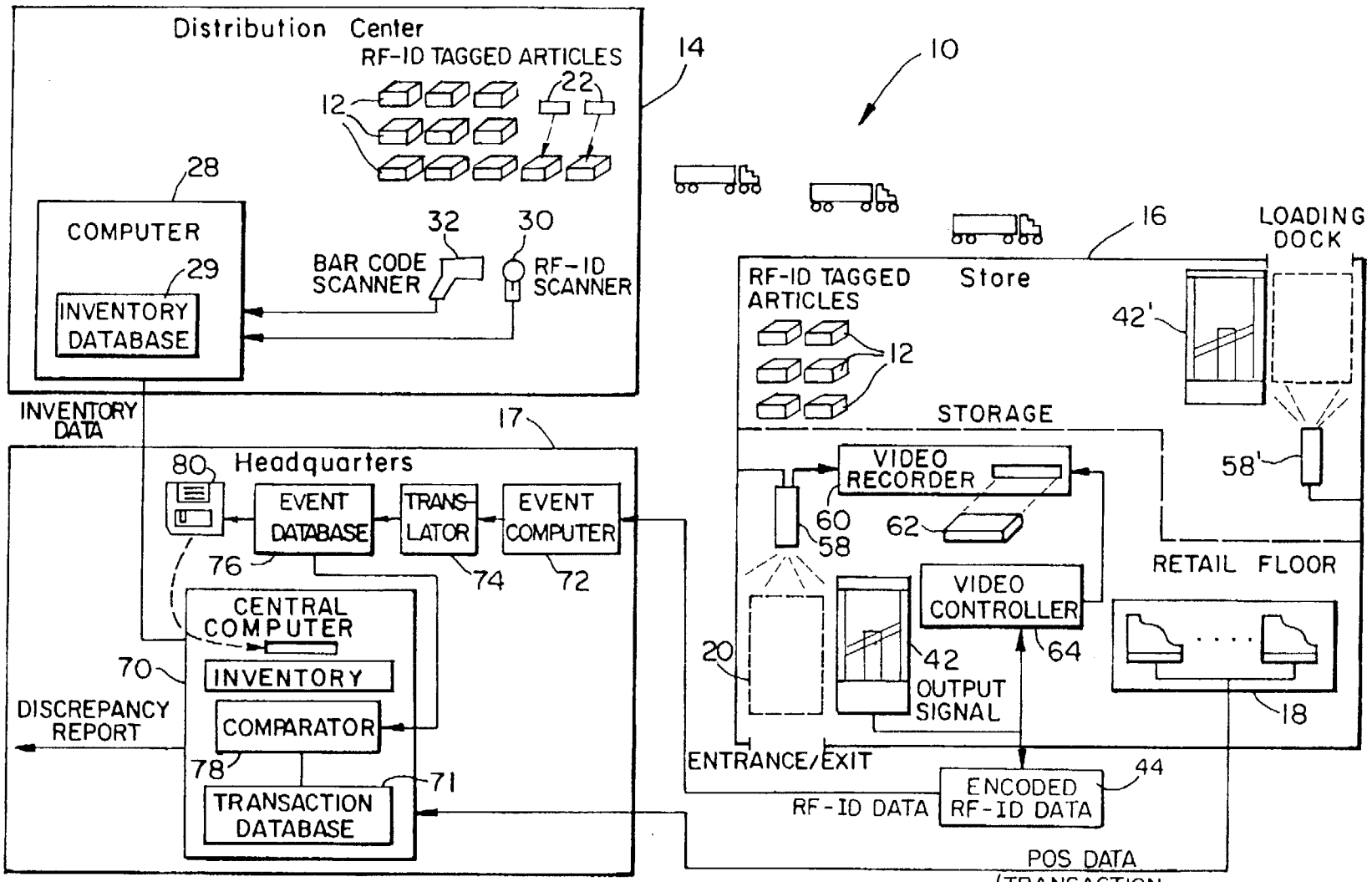
FIG. 7 is a detailed functional block diagram schematic of an electronic article security (EAS) system in accordance with a second preferred embodiment of the present invention.

Many variations to the system 10 are possible which are all within the scope of the invention. FIG. 7 shows one variation of a system 10'. The inventory computer 34 and the transaction database 40 of FIG. 1 are incorporated into a single central computer 70 at the headquarters 17. All POS data is received at the central computer 70 and stored in a transaction database 71. The RF-ID data is received at a dedicated event computer 72, translated by a translator 74 to extract the fields of data, and stored in an event database 76 therein. Periodically, the event database 76 is downloaded to the central computer 70 for data comparison by a comparator 78. The comparator 78 outputs a discrepancy report. The event database 76 may be downloaded directly to the central computer 70, or may be downloaded onto a floppy disk 80 which is then inserted into and read by the central computer 70. The remaining parts of the system 10' are identical to the system 10 in FIG. 1.

FIG. 8 shows a modified store floor plan for use with another embodiment of the present invention. In this embodiment, the store 100 includes some articles which are tagged with intelligent RF-ID security tags 22, and other articles which are tagged with conventional, (non-intelligent) physically deactivatable resonant security tags. For example, the store may tag large, expensive or frequently stolen articles 12 with security tags 22, while tagging small or inexpensive articles 12 with conventional security tags. In the modified floor plan, there are two exits for customers leaving the store, a main exit 102 and a merchandise exit 104. The customer exits through the main exit 102 if he or she buys an article tagged with a conventional security tag. (The customer also exits through the main exit 102 if an untagged article is purchased, or if no articles are purchased.) During the purchase transaction, the salesperson physically deactivates the conventional security tag, as is well known in the art. The main exit is monitored by a conventional pair of interrogators 106 which detect conventional resonant security tags that have not been physically deactivated. An alarm is triggered if the customer passes through the exit with an article having a conventional security tag that was not properly deactivated. If the customer purchases an article tagged with an intelligent RF-ID security tag 22 or an article of the type which might be tagged with an intelligent RF-ID security tags 22, the customer is directed to a customer pick-up counter 108 and the article 12 is brought to the customer from the storage area. After the article 12 is picked up, the customer is directed through a passageway 110 to exit the store through the merchandise exit 104. The merchandise exit 104 is monitored by an interrogator 42 and related interrogator output processing circuitry, and video recording equipment (camera 58, video recorder 60, video controller 64). FIG. 8 shows the interrogator 42, and camera 58 part of the video recording equipment. The loading dock (not shown) of the store also includes the same monitoring equipment shown in FIG. 1. The remaining parts of the system used with the FIG. 8 floor plan are the same as in the embodiment of FIG. 1. Intelligent security tags 22 are more expensive than conventional deactivatable security tags. The embodiment of FIG. 8 allows a store to use intelligent security tags for selected articles while relying upon more conventional security tags for controlling theft of other articles.

In an alternative embodiment of FIG. 8, the customer pick-up counter 108 is located in a room which is on another floor, in another building, or in another part of the same building containing the store 100. In this embodiment, a customer who is picking up an RF-ID tagged article 12 exits the store 100 through the main exit 102, walks to the room, picks up the article 12, and walks out of the room with the article 12. The interrogation and video recording equipment shown in FIG. 8 is located at the exit of the room.

The security tag interrogators used in the present invention can detect a plurality of articles 12 which are simultaneously passed therethrough. In most instances, each of the articles 12 receive and respond to the interrogation signal at a different instance in time, even when the articles 12 are physically close together. The string of returned signals is processed to sort out the individual IDs. However, if two articles 12 return an ID signal at exactly the same instance, the interrogator can also sort out the returned signals to recover the two distinct IDs.

Other variations of the present invention, without limitation, are listed below:

(1) A single computer may be used to perform all of the functions carried out in the headquarters.

(2) All of the functions carried out in the headquarters may be performed by computers located in the retail store 16.

(3) The retail store headquarters 17 may be located in the retail store distribution center 14 and a single inventory computer can be used.

(4) The RF-ID data and/or POS data may be stored locally at the store 16 and downloaded at periodic intervals to the headquarters 17.

(5) The video signals output from the video recorder 60 may be sent directly to the headquarters 17 for quicker discrepancy analysis.

(6) The comparator 66 can perform its function on a near real-time basis, instead of at periodic intervals. By continuously making comparisons throughout the day, quicker discrepancy analysis can occur. In effect, the system 10 can be configured to perform anticipatory analysis. Since the transaction data provides all of the information about which articles should pass by the interrogator 42, the system 10 can "anticipate" what the RFID data should be. If the RF-ID data does not match a completed transaction, the system 10 knows immediately that suspicious activity occurred.

(7) Additional article detection apparatus may be set up at a loading dock of the store 16, or at other entrances or exits of the store 16. FIG. 1 shows an interrogator 42' and video camera 58' monitoring activity at a zone near the store's loading dock. The outputs of the interrogator 42' and video camera 58' are processed in the same manner as the outputs of the interrogator 42 and video camera 58. The event database 46 would thus include activity detected at all entrances or exits.

(8) The security tag 22 may have two resonant frequencies, one which is physically deactivatable by store personnel upon purchase of the article 12, and one which is not or cannot be physically deactivated. In this scheme, the security tag 22 would be visible and accessible to store personnel, as is known in the prior art. The interrogator 42 would also be visible. One resonant frequency would be physically deactivated upon purchase. The other resonant frequency would be used for article detection and image capturing, as described in the preferred embodiments above. One advantage of this scheme is that the interrogator 42 can be used with an audible or visible alarm to detect theft of articles in real time. Another advantage of this scheme is that an employee who has improperly deactivated the frequency which causes the audible or visible alarm (to steal an article or to assist a customer in stealing an article), would still have his activity captured by the system 10.

(9) The communications between the parts of the system 10 can be performed using any suitable wired or wireless means.

(10) Discrepancy viewing software could be used to automatically forward the video storage medium to the points of discrepancy. One or two display screens would be used to simultaneously show the video, alongside the discrepancy data. Such a scheme is relatively easy to implement when using a random access video storage medium for the portable video storage medium 62, such as a writable CD-ROM.

(11) The security tag 22 may be hidden anywhere in or on the box or wrapper associated with the article, or it may be attached to the product itself, either on or inside the product.

(12) The security tag 22 may be an active device.

(13) The security tag 22 and interrogator 42 may operate at frequencies other than a radio frequency.

(14) inventory updating can be performed by using transaction data or RF-ID data. If transaction data is used, as described in the preferred embodiments above, the inventory data must be periodically modified to reflect any discrepancies, such as shrinkage, that is detected by the RF-ID data.

(15) If the security tags 22 are attached to the articles themselves, the tags 22 may also be used to monitor transactions which involve exchanges or returns, and to ensure that the customer has actually brought the article 12 back to the store 16.

(16) The system 10 can be used by libraries or video stores to monitor rental items such as books or videotapes. The only significant modification that would be necessary to the system 10 is that the POS data would be replaced by patron checkout information and the patron would present an ID card at the checkout counter. The checked out rental items would be assigned to the patron's ID number.

(17) The security tags 22 may be attached to the articles 12 at the point of manufacture and the memory 27 may be encoded with data identifying the product, in addition to serial number data. In this alternative scheme, it would not be necessary to create the FIG. 3 database or to access the FIG. 3 database when building the event database.

(18) The registers at the POS system 18 may be equipped with devices that scan a bar code on an article 12 while simultaneously reading the RF-ID security tag 22. The serial number of the article 22 becomes part of the transaction record shown in FIG. 4. When the customer exits the store and passes through the interrogation zone 20, the serial number of the article 22 is read again, and immediately checked against serial numbers of articles 22 purchased at the POS system 18 using the transaction records.

(19) The interrogators 42 and 42' may be designed to detect both conventional, (non-intelligent) deactivatable resonant security tags and security tags 22. In this manner, the same interrogator may be used to detect the removal of conventionally tagged articles which have not been properly deactivated. Likewise, interrogators 106 in FIG. 8 may be designed to detect both security tags 22 and conventional, (non-intelligent) deactivatable resonant security tags. In this manner, an RF-ID tagged article which is removed from the store 100 through the main exit 102, instead of through the merchandise exit 104, will not escape detection.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An electronic article security system for use in conjunction with articles having a security tag attached thereto, the security tag including a resonant circuit for use in detecting the presence of the article by receiving an interrogation signal and returning a response signal, and an integrated circuit connected to the resonant circuit for storing article identification information and for outputting the article identification information with the response signal upon interrogation of the security tag, the system comprising:

(a) one or more point-of-sale terminals for recording article transactions including article purchases, the transaction records including specific product identification information;

(b) an interrogator for monitoring a detection zone for disturbances in the form of a response signal caused by the presence of a security tag within the zoned the interrogator outputting an interrogator output signal when a security tag is detected in the zone, each interrogator output signal including the article identification information stored in the integrated circuit, the interrogator output signal bring obtained at a location and time which is different than the location and time that the article transaction are recorded; and (c) a computer for receiving and storing the transaction records and the interrogator output signals, the computer including a comparator for comparing the transaction records and the interrogator output signals, including the product and article identification information, and detecting any discrepancies which occur therebetween.

2. A system according to claim 1 wherein each of the interrogator output signals is encoded, the system further including a decoder for decoding the interrogator output signals, the decoder having an input connected to the interrogator output signal and an output connected to the computer.

3. A system according to claim 2 wherein the decoder is located remotely from the interrogator.

4. A system according to claim 3 wherein the decoder is also located remotely from the computer.

5. A system according to claim 1 further comprising:

(d) a video camera for capturing images of the detection zone and outputting video signals of the captured images; and (e) a video recorder for storing the video signals on a video storage medium, the video storage medium being used to investigate the detected discrepancies.

6. A system according to claim 5 wherein the video recorder makes a continuous record of activity in the detection zone.

7. A system according to claim 5 further comprising:

(f) a video controller for activating the video recorder upon detection of a security tag in the detection zone, and deactivating the video recorder a predetermined period of time after a security tag is no longer detected in the detection zone, the video storage medium recording the time of each activation.

8. A system according to claim 1 wherein the transaction records include time of purchase data, and the interrogator output signals include time of security tag detection, and the comparator further compares the time of purchase data and time of security tag detection and detects any discrepancies therebetween.

9. A system according to claim 8 further comprising:

(d) a video camera for capturing images of the detection zone and outputting video signals of the captured images; and (e) a video recorder for storing the video signals on a video storage medium, the video storage medium being used to investigate the detected discrepancies, wherein the video recorder stores time information on the video storage medium for use in investigating the detected discrepancies by reviewing the video signal captured at about the time of the detected discrepancy.

10. A system according to claim 1 wherein the article identification information includes identification information regarding the security tag itself, the identification information for each security tag being unique or semi-unique.

11. A system according to claim 1 wherein the computer includes inventory data regarding articles monitored by the system, and the inventory data is updated in response to the transaction records received from the one or more point-of-sale terminals.

12. A system according to claim 1 wherein the interrogator includes a transmitter, a receiver, and an antenna assembly for interrogating the detection zone and for receiving a raw output signal therefrom, and data processing and control means for processing the raw output signal to obtain the output signal to be sent to the computer.

13. A system according to claim 1 wherein the security tag is a passive-type radio frequency intelligent tag.

14. A system according to claim 1 wherein the computer is located remotely from the one or more point-of-sale terminals and remotely from the interrogator.

15. A system according to claim 1 wherein the article identification information includes identification information regarding the security tag itself, the identification information for each security tag being unique or semi-unique, and the computer further includes a memory which stores data correlating each security tag with its respective product identification, the respective product identification being used by the comparator.

16. A method for monitoring a collection Of articles for shrinkage, each of the articles in the collection having a security tag attached thereto, the security tag including a resonant circuit for use in detecting the presence of the article by receiving an interrogation signal and returning a response signal, and an integrated circuit connected to the resonant circuit for storing article identification information and for outputting the article identification information with the response signal upon interrogation of the security tag by an interrogator of an electronic article security system, the method comprising the steps of:

(a) recording article transactions, including article purchases, at one or more point-of-sale terminals, the transaction records including specific product identification information;

(b) monitoring a detection zone with the interrogator for disturbances in the form of a response signal caused by the presence of a security tag within the zoned the interrogator outputting an interrogator output signal when a security tag is detected in the zoned each interrogator output signal including the article identification information stored in the integrated circuit, the, interrogator output signal being obtained at a location and time which is different than the location and time that the article transactions are recorded;

(c) sending the transaction records and the interrogator output signals to one or more computers for storage therein; and (d) comparing in a computer the stored transaction records and the interrogator output signals, including the product and article identification information, and detecting any discrepancies which occur therebetween.

17. A method according to claim 16 wherein the transaction records include time of purchase data, and the interrogator output signals include time of security tag detection, and the comparing step (d) includes comparing the time of purchase data and time of security tag detection and detecting any discrepancies therebetween.

18. A method according to claim 17 further comprising the steps of:

(e) capturing images of the detection zone using a video camera and outputting video signals of the captured images; and (f) recording the video signal and related time information on a video storage medium, the video storage medium being used to investigate the detected discrepancies by reviewing the video signal captured at about the time of the detected discrepancy.

19. A method according to claim 16 further comprising the steps of:

(e) capturing images of the detection zone using a video camera and outputting video signals of the captured images; and (f) recording the video signal on a video storage medium, the video storage medium being used to investigate the detected discrepancies.

20. A method according to claim 19 further comprising the step of recording the video signal upon detection of a security tag in the zone, and stopping the recording a predetermined period of time after a security tag is no longer being detected as being in the detection zone, the video storage medium recording the time of each activation.

21. A method according to claim 19 wherein the recording in step (f) is a continuous record of activity in the detection zone.

22. A method according to claim 16 wherein each of the interrogator output signals is encoded, the method further comprising the step of decoding the interrogator output signals in a decoder, the decoder having an input connected to the interrogator output signal and an output connected to the one or more computers.

23. A method according to claim 16 wherein the one or more computers includes inventory data regarding articles monitored by the system, the method further comprising the step of updating the inventory data in response to the transaction records received from the one or more point-of-sale terminals.

24. A method according to claim 16 wherein the article identification information includes identification information regarding the security tag itself, the identification information for each security tag being unique, the method further including the step of storing data correlating each security tag with its respective product identification, the respective product identification being used in the comparison step (d).

* * * * *